US008113821B2

(12) United States Patent
Feese et al.

(10) Patent No.: US 8,113,821 B2
(45) Date of Patent: Feb. 14, 2012

(54) PREMIX LEAN BURNER

(75) Inventors: James J. Feese, Elizabethtown, PA (US); Bruce A. Wartluft, Lebanon, PA (US); Jacob W. Mattern, Lebanon, PA (US)

(73) Assignee: Hauck Manufacturing Company, Lebanon, PA (US)

( * ) Notice: Subject to any disclaimer, the term of this patent is extended or adjusted under 35 U.S.C. 154(b) by 61 days.

(21) Appl. No.: 12/044,548

(22) Filed: Mar. 7, 2008

(65) Prior Publication Data

US 2009/0226852 A1 Sep. 10, 2009

(51) Int. Cl.

| | |
|---|---|
| ***F23M 3/00*** | (2006.01) |
| ***F23M 3/02*** | (2006.01) |
| ***F23C 3/00*** | (2006.01) |
| ***F23C 7/00*** | (2006.01) |

(52) U.S. Cl. ..... 431/9; 431/8; 431/116; 431/158; 431/183; 431/187

(58) Field of Classification Search ..... 431/8, 9, 431/183, 158, 187, 254, 116
See application file for complete search history.

(56) References Cited

U.S. PATENT DOCUMENTS

| | | | | |
|---|---|---|---|---|
| 3,154,134 | A * | 10/1964 | Bloom | 239/416.5 |
| 4,559,009 | A | 12/1985 | Marino et al. | |
| 5,259,755 | A | 11/1993 | Irwin et al. | |
| 5,351,477 | A * | 10/1994 | Joshi et al. | 60/39.463 |
| 5,407,345 | A | 4/1995 | Robertson et al. | |
| 5,511,970 | A | 4/1996 | Irwin et al. | |
| 5,554,021 | A | 9/1996 | Robertson et al. | |
| 5,573,396 | A | 11/1996 | Swanson | |
| 5,685,707 | A * | 11/1997 | Ramsdell et al. | 431/90 |
| 5,807,094 | A * | 9/1998 | Sarv | 431/177 |
| 5,957,682 | A * | 9/1999 | Kamal et al. | 431/328 |
| 6,312,250 | B1 | 11/2001 | Neville et al. | |
| 6,524,098 | B1 * | 2/2003 | Tsirulnikov et al. | 431/9 |
| 6,575,734 | B1 | 6/2003 | Brashears et al. | |
| 6,619,951 | B2 * | 9/2003 | Bodnar et al. | 431/329 |
| 6,652,268 | B1 * | 11/2003 | Irwin et al. | 431/284 |
| 7,127,899 | B2 * | 10/2006 | Sprouse et al. | 60/776 |
| 2008/0280243 | A1 * | 11/2008 | Swanson et al. | 431/254 |

* cited by examiner

*Primary Examiner* — Kenneth Rinehart
*Assistant Examiner* — William Corboy
(74) *Attorney, Agent, or Firm* — Woodcock Washburn LLP

(57) ABSTRACT

A burner assembly for lean, low NOx combustion may include a gaseous fuel manifold, counter-swirl vanes, and a converging nozzle with bluff body flame anchors. A cooling air tube optionally extends from the air inlet to the nozzle.

27 Claims, 8 Drawing Sheets

PREMIX LEAN BURNER

FIELD OF THE INVENTION

This invention relates generally to combustion equipment, and more particularly, it relates to apparatus and methods for lean premix low NOx combustion.

BACKGROUND OF THE INVENTION

Burners may be used in a wide range of well known applications, such as the drying and heating of materials. Stricter regulatory requirements have created a demand for burners that produce low levels of nitrogen oxides (NOx), carbon monoxide (CO) and volatile organic compounds (VOCs). These emissions are a significant source of air pollution, and are thus undesirable.

Several well known techniques for reducing NOx emissions are not well suited for certain burner applications, where, for instance, a compact burner size is required. NOx reduction techniques, such as exhaust gas recirculation or water injection, may not be easy to implement in these applications and may produce undesirable secondary effects, such as reduced thermal and/or combustion efficiency. There is a need for improved burners producing low NOx.

SUMMARY OF THE INVENTION

A burner assembly and related methods are disclosed for lean, low NOx combustion. A burner assembly includes: a combustion air inlet; a gaseous fuel inlet manifold located downstream from the combustion air inlet; counter-swirl vanes located proximate the fuel inlet manifold; and a nozzle assembly that is located downstream from and spaced apart from the counter-swirl vanes and that is located downstream from and spaced apart from the gaseous fuel inlet manifold. The manifold has multiple ports for introducing gaseous fuel. The counter-swirl vanes include inner vanes oriented to impart a swirl in a first orientation and outer vanes oriented to impart a swirl in a second orientation that is opposite to that of the first orientation. Accordingly, mixing between the fuel and the combustion air is enhanced.

The spacing of the nozzle relative to the vanes forms a mixing zone between the vanes and the nozzle assembly. The nozzle assembly includes at least one flame anchor formed by a bluff surface located proximate a front of the nozzle assembly for anchoring the flame. The burner assembly preferably includes a fan coupled to the combustion air inlet for providing combustion air through the combustion air inlet to the nozzle assembly in excess of the stoichiometric amount such that the fuel-air mixture is fuel-lean. The burner assembly may also be supplied with combustion air from a manifold or other means.

At least a portion of the ports of the gaseous fuel manifold in the burner assembly are distributed in a plane that generally is perpendicular to a longitudinal axis of the burner assembly. Preferably, said burner assembly includes a converging housing cone generally located between the vanes and the front of the nozzle assembly wherein the nozzle assembly includes at least one converging nozzle cone that cooperates with the converging housing cone to direct flow of the fuel-air mixture. Said nozzle assembly includes at least one converging nozzle cone to direct flow of the fuel-air mixture, wherein the bluff surface of the nozzle assembly is preferably formed proximate the converging nozzle cone.

The burner assembly further includes a diverging cone extending forward from the nozzle assembly, whereby the diverging cone inhibits entrainment toward the front of the nozzle. The burner assembly preferably comprises a cooling air tube extending from the combustion air inlet, through the gaseous fuel manifold, and into a burner housing wherein the nozzle assembly optionally includes an oil nozzle, and the burner assembly optionally includes an oil supply tube capable of providing oil to said oil nozzle and an atomizing air tube capable of providing atomizing air to the oil nozzle.

In an alternate embodiment, a burner assembly for low NOx combustion comprises: a combustion air inlet; a gaseous fuel inlet; a housing; and a nozzle assembly. Said housing defines a mixing zone downstream of the combustion air inlet and downstream of the gaseous fuel inlet for enabling mixing of fuel and combustion air to form a lean fuel-air mixture. The nozzle assembly includes at least: a converging cone for directing the fuel-air mixture; at least one flame anchor formed by a bluff surface located proximate a front of the nozzle assembly for anchoring the flame; an optional oil nozzle located concentric with the converging cone; an optional oil supply tube for providing oil to the oil nozzle; and an air tube extending from the combustion air inlet capable of providing cooling air to the oil nozzle during operation of the burner assembly on oil and providing cooling air to the oil nozzle during operation of the burner assembly only on gaseous fuel. Preferably, the bluff surface is formed proximate a front of the burner assembly and said front of the burner is vaneless.

The burner assembly, in accordance with said alternate embodiment, further comprises a swirl vane assembly for mixing the combustion air with the gaseous fuel upstream of the nozzle assembly. Said swirl vane assembly includes a plurality of inner vanes that impart a swirling motion in a first orientation and a plurality of outer vanes that impart a swirling motion in a second orientation wherein said first orientation may be the same as said second orientation. Preferably, the swirling motion imparted by the plurality of inner vanes is opposite in orientation to the swirling motion imparted by the plurality of outer vanes.

A method for generating low NOx, premixed combustion comprises: supplying and controlling flow of excess combustion air at a burner inlet; introducing gaseous fuel to the burner through a multi-port manifold located downstream the burner inlet; mixing the excess combustion air with the gaseous fuel by means of counter-swirl vanes located proximate the multi-port manifold; directing the air-fuel mixture flow through a nozzle assembly located generally within a converging housing cone; and providing a flame anchor formed by a bluff surface located proximate a front of the nozzle assembly for anchoring the flame. Preferably, the bluff surface is formed proximate the converging nozzle cone.

The combustion air is preferably supplied by a fan that is coupled to the burner inlet. Combustion air may also be supplied to the burner assembly from a manifold or other means. A portion of the fuel-air mixture is directed through a converging housing cone generally located between the vanes and the front of the nozzle assembly wherein said nozzle assembly includes at least one converging nozzle cone that cooperates with the converging housing cone to direct flow of the fuel-air mixture.

The burner assembly, according to the method described herein, further comprises a cooling air tube extending from the combustion air inlet, through the gaseous fuel manifold, and into the burner housing for providing cooling air to the nozzle assembly. Said nozzle assembly optionally includes an oil nozzle and the burner assembly optionally comprises an oil supply tube for providing oil to the oil nozzle and an atomizing air tube for providing atomizing air to the oil nozzle. Combustion according to the method described herein achieves NOx emissions levels below 20 ppm at 3 percent $O_2$.

DETAILED DESCRIPTION OF ILLUSTRATIVE EMBODIMENTS

Figure 1:
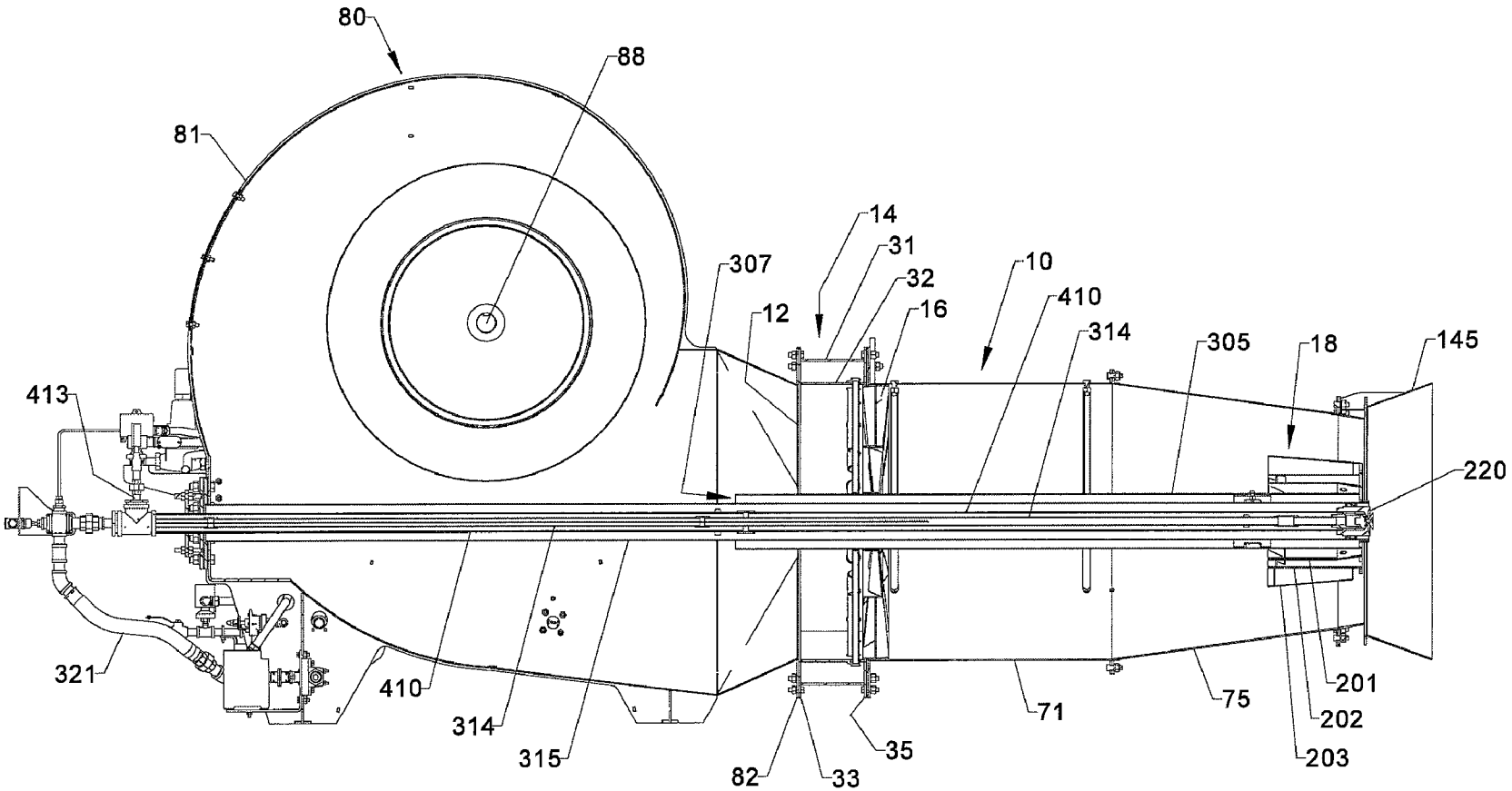
FIG. 1 is a side elevation of an embodiment of a burner assembly and a combustion air fan illustrating aspects of the present invention.
Figure 2:
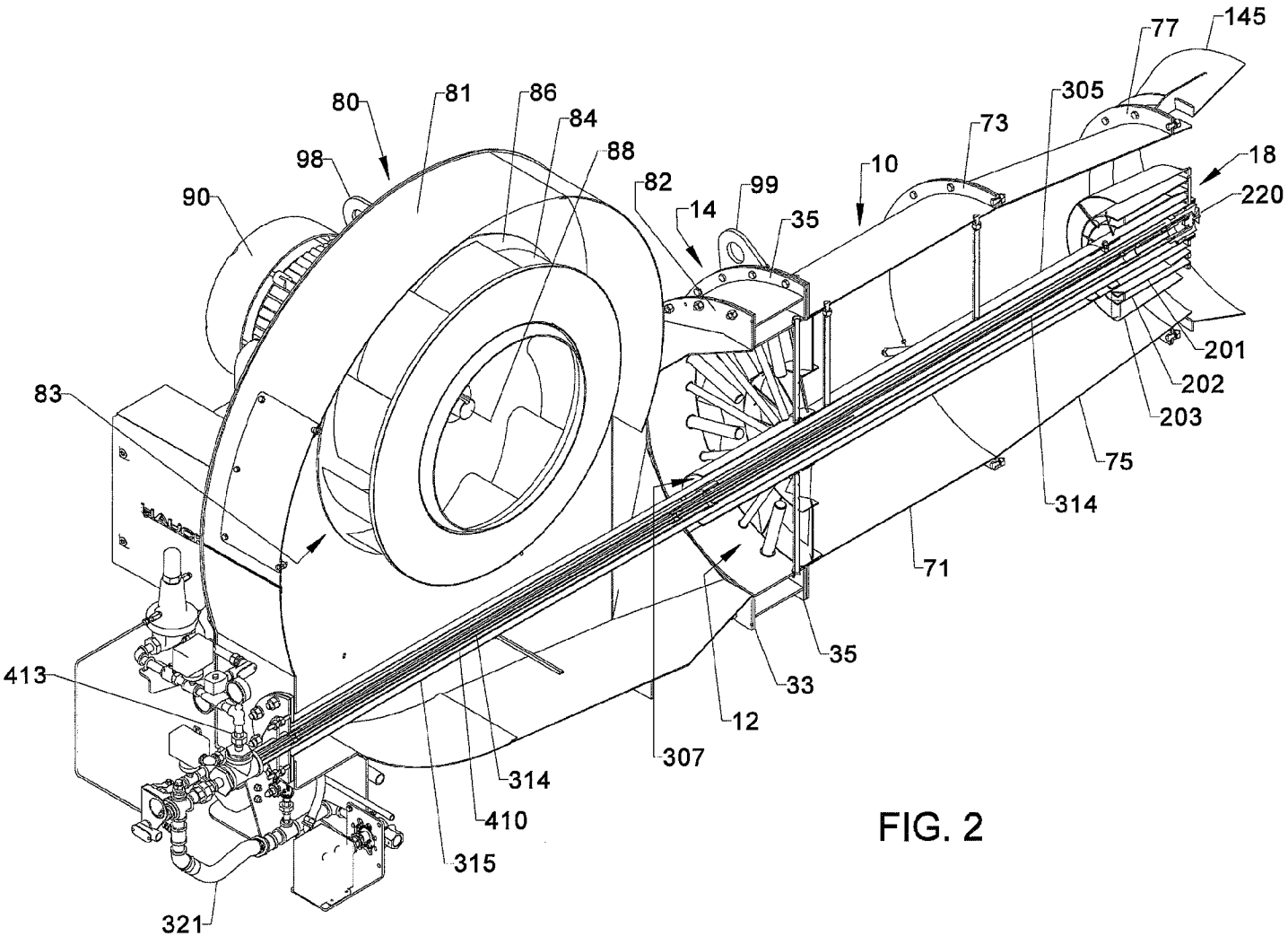
FIG. 2 is a sectional perspective view of the burner assembly and combustion air fan of FIG. 1.

FIG. 1 and FIG. 2 depict an embodiment of a premix lean burner assembly for low NOx combustion. As shown, a burner assembly 10 may include a combustion air inlet 12, a gaseous fuel inlet manifold assembly 14, a counter-swirl vane assembly 16 and a nozzle assembly 18.

Combustion air inlet 12 may include a first flange 33 that may be integral with the gaseous fuel inlet manifold assembly 14 (as more fully described below) for attaching to a combustion air fan 80. Combustion air fan 80 preferably is a conventional centrifugal fan having a tangential outlet. Combustion air fan 80 includes a fan housing 81, a mating flange 82 and a fan wheel 83 having a plurality of blades 84 and a fan hub 86 for mounting the plurality of blades 84. FIG. 2 also shows a fan motor 90 and a fan driveshaft 88 for turning the fan hub 86. The present invention is not limited to the structure of combustion air fan 80, but rather encompasses employing any fan type or structure, and encompasses any source of air provided to the burner assembly such that no fan is required unless specifically stated in the claim.

The gaseous fuel inlet manifold assembly 14 has a second flange 35 for attaching to a burner housing. The burner housing preferably includes cylindrical housing section 71 and a frusto-conical housing section or converging housing cone 75, as best shown in the embodiment depicted in FIG. 2. The housing portions of the manifold assembly may also be considered a portion of the burner assembly housing depending on the context, as will be clear to persons familiar with burner technology.

Figure 3:
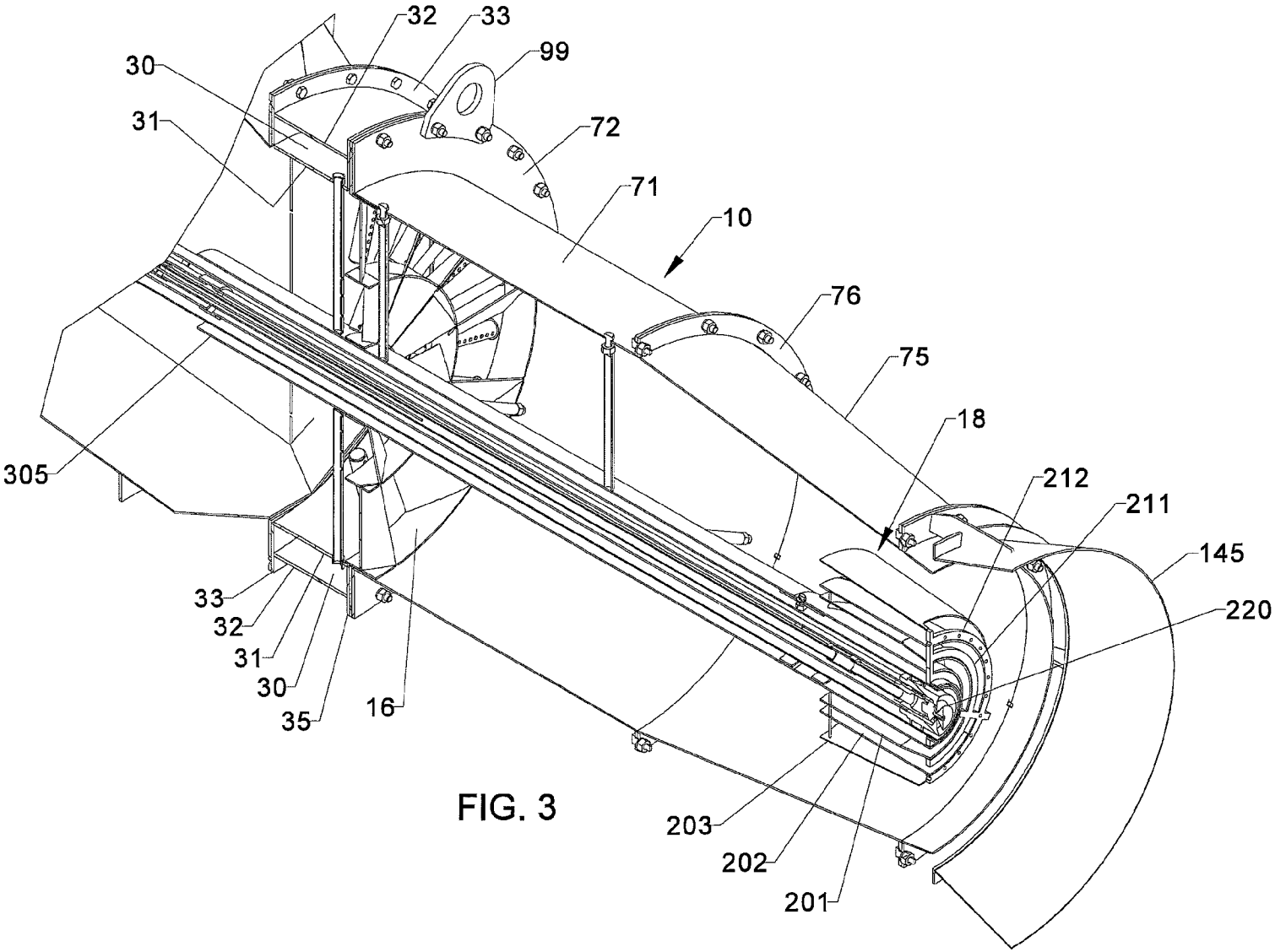
FIG. 3 is an enlarged sectional perspective view of the burner assembly of FIG. 1.

FIG. 3 shows an enlarged sectional perspective view of the burner assembly 10. Gaseous fuel inlet manifold assembly 14 may include a gaseous fuel chamber 30, which is partially defined by flanges 33 and 35, both of which are attached to an inner cylindrical shell 31 and an outer cylindrical shell 32. The inner cylindrical shell 31 may be concentric with the outer cylindrical shell 32 to form a plenum for distributing gas fuel.

Referring now to FIGS. 2 and 3, the cylindrical housing section 71 further comprises a first housing flange 72 for attaching to the gaseous fuel inlet manifold assembly 14 and a second housing flange 73 for attaching to the frusto-conical housing section 75. Furthermore, frusto-conical housing section 75 may further include an upstream flange 76 for attaching to the cylindrical housing section 71 and a downstream flange 77 for attaching to a diverging cone 145 proximate the downstream end of the burner assembly 10. In addition, as shown in FIGS. 2 and 3, lifting eyes 98 and 99 may be attached to the combustion air fan 80 and the burner assembly 10 for easy lifting an relocation of the fully assembled unit shown in FIG. 2.

Figure 4:
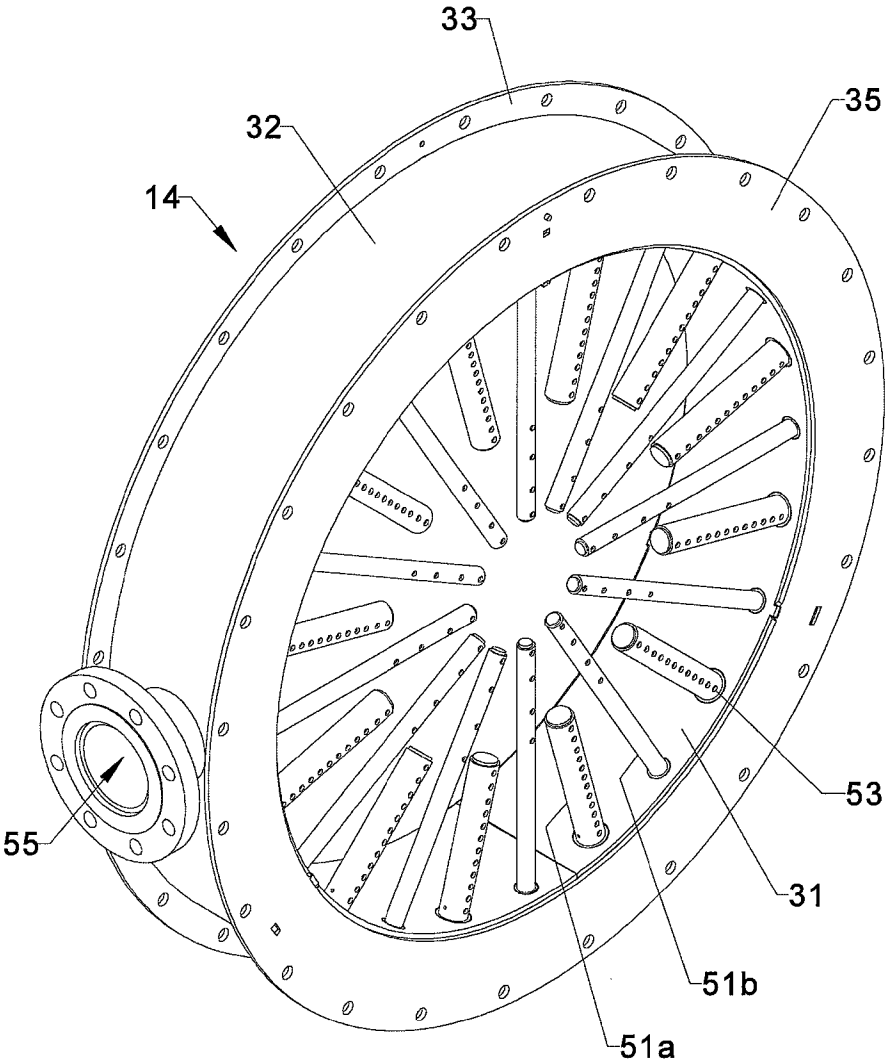
FIG. 4 is an enlarged perspective view of the gaseous fuel inlet manifold assembly shown in FIG. 3.
Figure 5:
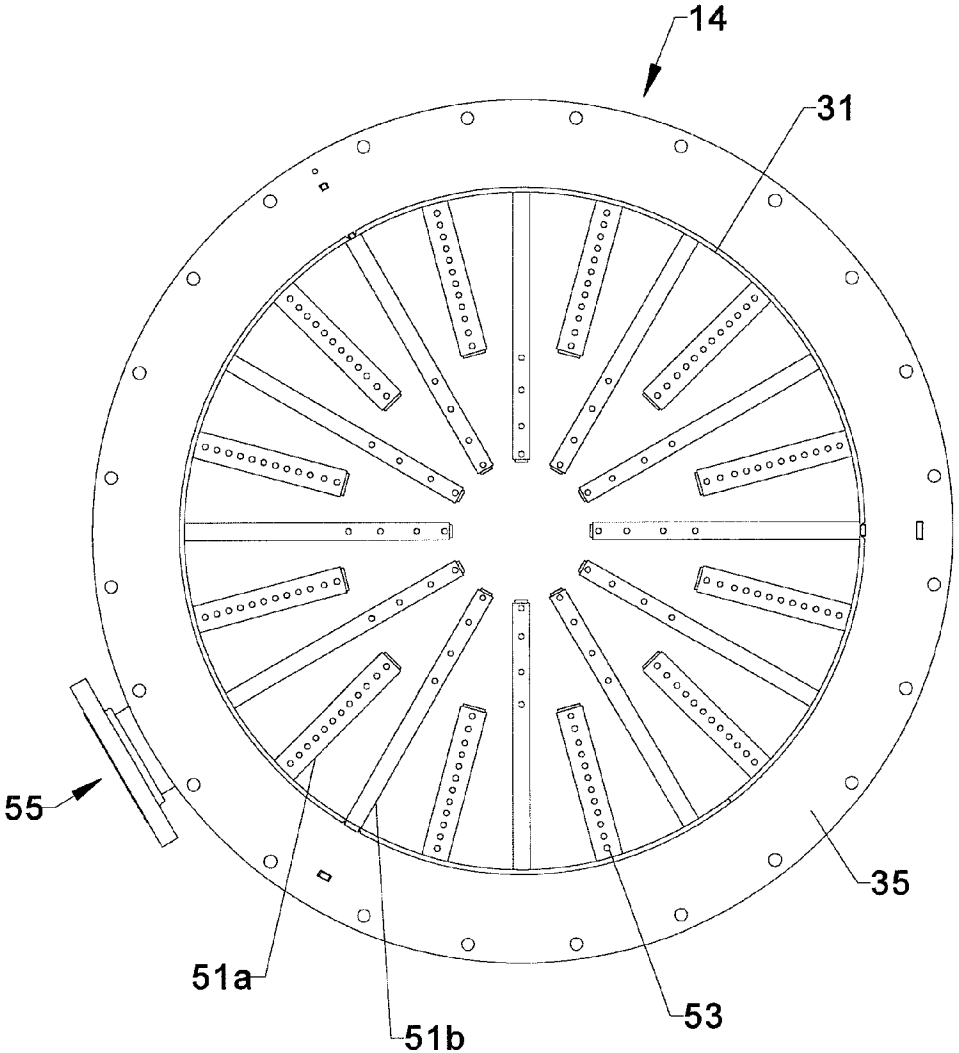
FIG. 5 is an end view of the gaseous inlet manifold assembly of FIG. 4.

FIG. 4 depicts a perspective view of gaseous fuel inlet manifold assembly 14. As FIG. 4 shows, the gaseous fuel inlet manifold assembly 14 further comprises a main fuel inlet 55 and a plurality of tubes 51, each tube having a multiplicity of perforations or ports 53. The tubes 51 may be cylindrical in shape and may generally extend radially inward, from the gaseous fuel chamber 30 (shown in FIG. 3), toward the center of the circumference formed by the inner cylindrical shell 31. As seen in FIG. 4, the plurality of tubes 51 may be of varying length and diameter. As an example, the gaseous fuel inlet manifold shown in FIG. 4 is configured with alternating short tubes 51*a* and long tubes 51*b*, with the short tubes 51*a* extending distally a fraction of the distance that the long tubes 51*b* extend. The exemplary long-short tube configuration just described may also be seen in FIG. 5, which shows an end view depiction of the gaseous fuel inlet manifold assembly 14.

Figure 6:
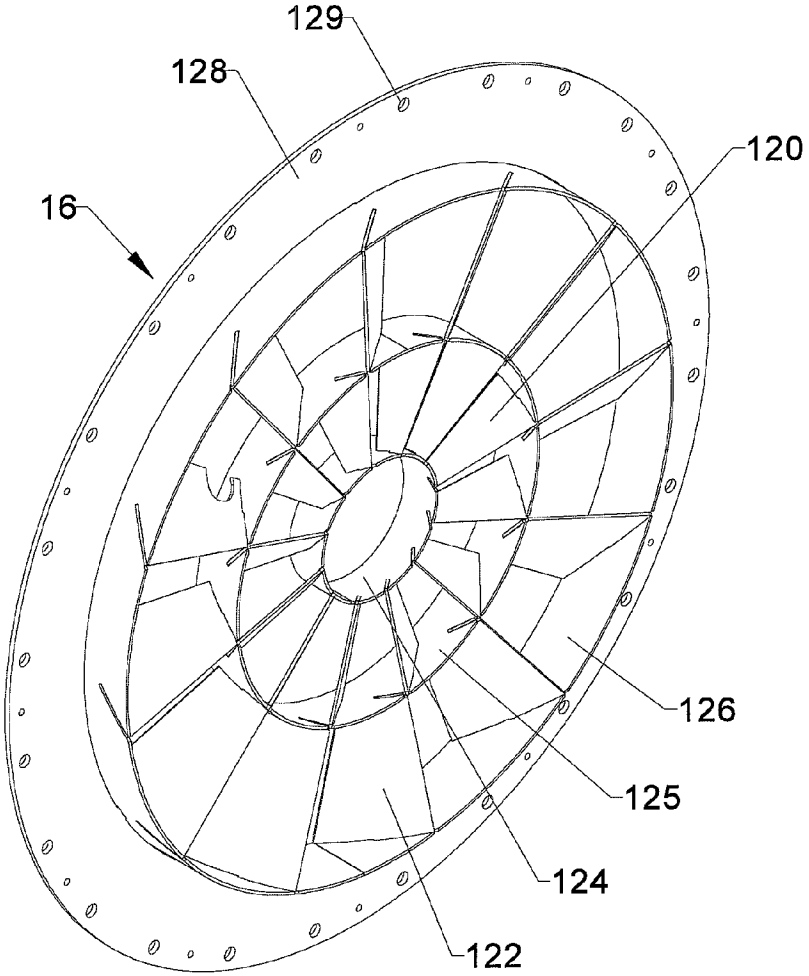
FIG. 6 is an enlarged perspective view of the counter-swirl vane assembly shown in FIG. 3.

FIG. 6 shows an embodiment of the preferred configuration of the counter-swirl vane assembly, which is indicated by reference numeral 16 and includes a plurality of inner vanes 120 and a plurality of outer vanes 122, each of which is configured radially. Counter-swirl vane assembly 16 is housed in a central cylindrical shell 124, an intermediate cylindrical shell 125, and a peripheral cylindrical shell 126. Cylindrical shells 124 and 125 may be used for attaching the inner vanes 120 and cylindrical shells 125 and 126 may be used for attaching the outer vanes 122. In the exemplary embodiment shown in FIG. 6, the inner vanes 120 may be located between the central cylindrical shell 124 and the intermediate cylindrical shell 125 whilst the outer vanes 122 may be located between the intermediate cylindrical shell 125 and the peripheral cylindrical shell 126. Preferably, the inner vanes 120 are disposed in an orientation opposite that of the outer vanes 122. As shown in FIG. 6, the counter-swirl vane assembly 16 may further comprise a flange 128 with a plurality of bolt holes 129, for example, for attaching to the gaseous fuel inlet manifold assembly 14.

Figure 7:
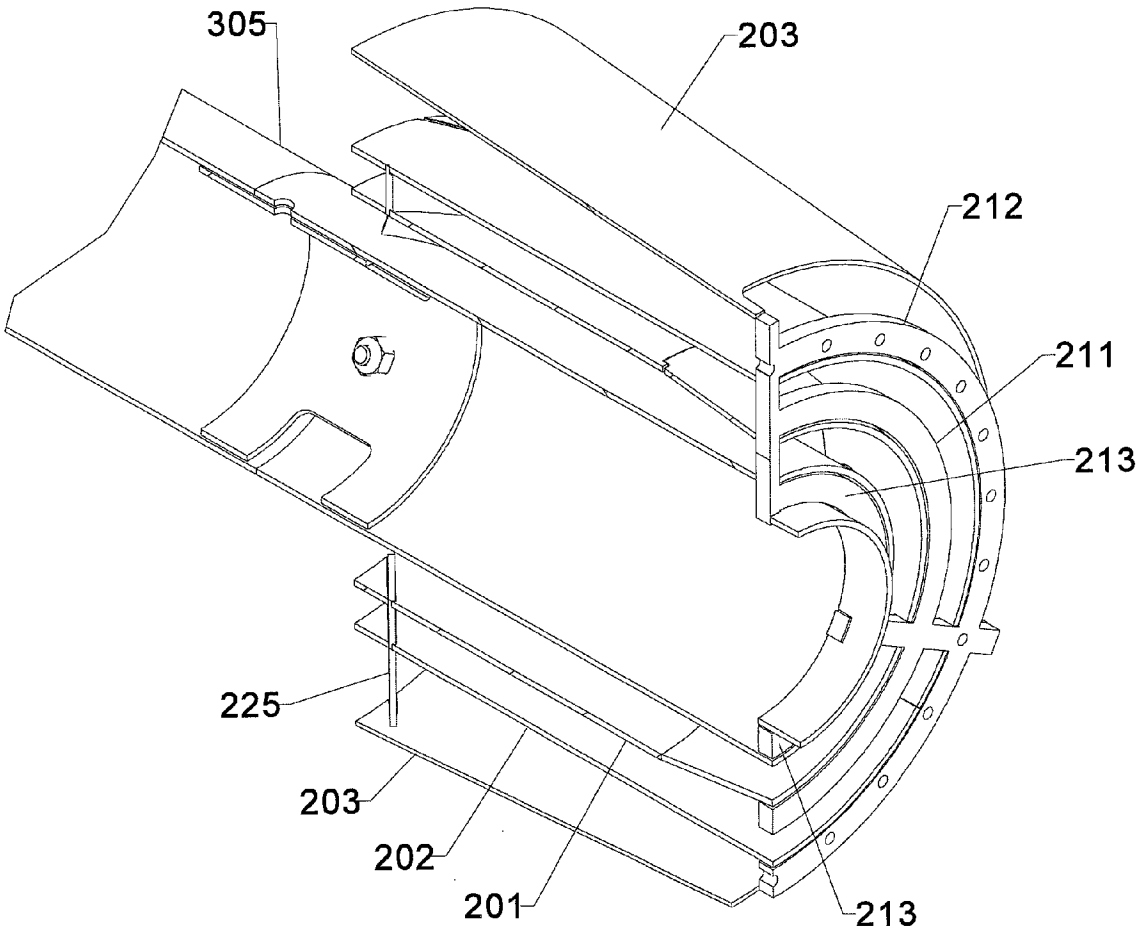
FIG. 7 is an enlarged sectional perspective view of the nozzle assembly shown in FIG. 1.

FIG. 7 depicts an embodiment of the nozzle assembly 18. As shown, the nozzle assembly 18 includes a first cylindrical shell 201, a second cylindrical shell 202, and a converging nozzle cone 203. The first cylindrical shell 201 preferably is concentric with the second cylindrical shell 202, and preferably includes a bluff structure having a first bluff surface 211. The second cylindrical shell 202 has a diameter greater than that of the first cylindrical shell 201 and preferably includes a bluff structure having a second bluff surface 212. A cooling air tube 305 (as more fully described below) is located within shell 201, and preferably includes a bluff structure having a third bluff surface 213. Bluff surfaces 211, 212, and 213 may be integral with cylindrical shells 201 and 202, and cooling air tube 305, respectively, or may each be attached to corresponding structure 201, 202, and 305 as separate pieces, respectively. Furthermore, bluff surfaces 211, 212, and 213 may generally be located toward the front, or downstream end, of the nozzle assembly 18. Cylindrical shells 201 and 202, and converging cone 203 may extend from a same upstream longitudinal location toward the front of the nozzle assembly 18. As FIG. 7 shows, cylindrical shells 201 and 202 may generally extend longitudinally downstream the same distance as each other to the downstream end of the burner assembly. Converging nozzle cone 203 may extend longitudinally a fraction of the distance that cylindrical shells 201 and 202 extend such that a space is formed between the second bluff surface 212 and the downstream end of the converging cone 203 where fuel-air mixture may flow. The present invention is not limited to the structure of the cones or bluff bodies particularly disclosed herein.

Referring again to FIGS. 1 and 2, the burner assembly 10 may include cooling air tube 305 having a combustion air opening 307 located proximate the combustion air inlet 12. The cooling air tube 305 extends along the longitudinal axis of burner assembly 10 through gaseous fuel inlet manifold assembly 14, counter-swirl vane assembly 16 and nozzle assembly 18. Burner assembly 10 may also include an oil supply tube 314, a primary air tube 315 and an atomizing air tube 410, which preferably are concentric with the cooling air tube 305. Oil supply tube 314, primary air tube 315 and atomizing air tube 410 extend the length of the burner assembly 10 through the gaseous fuel inlet manifold assembly 14, counter-swirl vane assembly 16, and nozzle assembly 18. Oil supply tube 314 and atomizing air tube 410 may further extend into and through the fan housing 81. The oil supply tube 314 may extend outside of fan housing 81 where the oil supply tube 314 is capable of receiving a flow of oil from an external oil source (not shown) through an oil hose 321. The primary air tube 315 may be used for centering an oil nozzle 220 and for providing cooling air to nozzle assembly 18. The atomizing air tube 410 may extend out of the fan housing 81 where the compressed air tube may receive a flow of compressed air from an external compressed air source (not shown) through a compressed air pipe 413.

Figure 8:
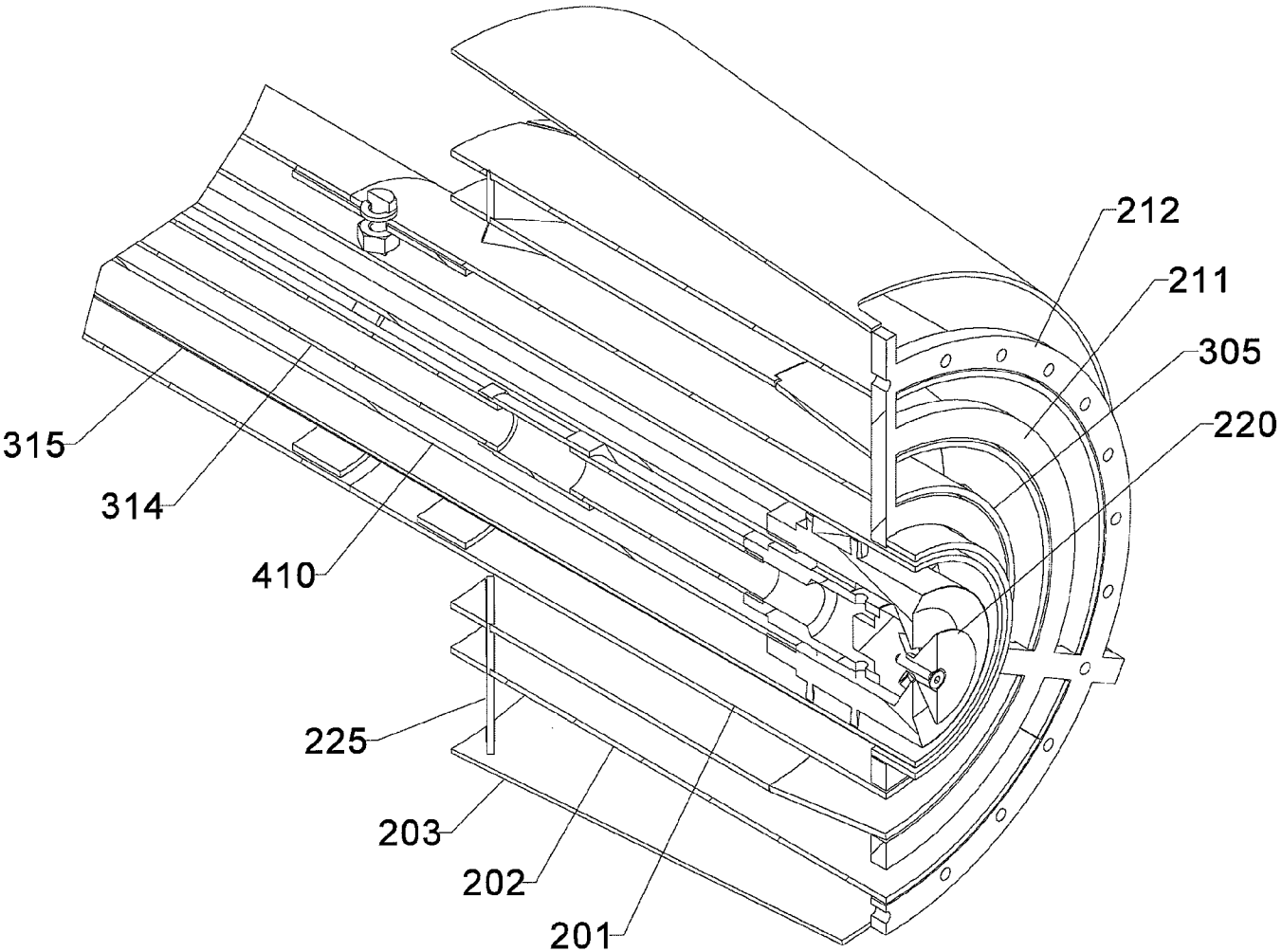
FIG. 8 is an enlarged sectional view of the nozzle assembly portion of the burner assembly of FIG. 3.

FIG. 8 illustrates another embodiment of the nozzle assembly 18. As shown in FIG. 8, nozzle assembly 18 includes oil nozzle 220 for receiving oil from the oil supply tube 314. Said oil nozzle 220 may be in fluid communication with atomizing air tube 410. Oil nozzle 220 may be configured to burn any liquid fuel, such as fuel oil, biodiesel, recycled motor oil, and the like. As shown in FIG. 8, said fuel may be directed to the oil nozzle 220 through oil supply tube 314. The fuel may then be atomized, for example, with compressed air, which may flow to the oil nozzle 220 through atomizing air tube 410 before being ignited at the front of the nozzle assembly 18.

As will be apparent from the discussion below, the description of the function and operation of the burner assembly 10 is provided simultaneously with a description of a method according to an aspect of the present invention.

Referring now to FIG. 2, power is supplied to fan motor 90 of combustion air fan 80 to provide combustion air to the burner assembly 10. Motor 90 driving fan blades 84 via shaft 88 provides combustion air to burner assembly 10.

As shown in FIGS. 2-4, mating flange 82 of the combustion air fan 80 is bolted to the first flange 33 of gaseous fuel inlet manifold assembly 14 such that combustion air discharged from combustion air fan 80 enters the burner assembly 10 through the combustion air inlet 12. Upon passing through the combustion air inlet 12, the combustion air discharge flows through the gaseous fuel inlet manifold assembly 14 around the plurality of tubes 51. Gaseous fuel is introduced from an external source (not shown) into the main gaseous fuel inlet 55 of the gaseous fuel inlet manifold assembly 14 such that the gaseous fuel chamber 30 is filled with gaseous fuel and said gaseous fuel flows into the plurality of tubes 51*a* and 51*b* and exits through the multiplicity of ports 53 into the combustion air stream. Ports 53 preferably are generally directed in the downstream direction of the burner assembly 10, and other configurations are contemplated. The combustion air stream flows around the plurality of tubes 51 of the gaseous fuel inlet manifold assembly 14 such that the combustion air entrains gaseous fuel flowing out of the multiplicity of port 53 in tubes 51*a* and 51*b* of the gaseous fuel inlet manifold assembly 14.

As can be observed in FIGS. 2, 3 and 6, upon passing through gaseous fuel inlet manifold assembly 14, the combustion air discharge and gaseous fuel flows through counter-swirl vane assembly 16 which is attached to the gaseous fuel inlet manifold assembly 14 by, for example, fastening with bolts the flange 128 of the counter-swirl vane assembly to the second flange 35 of the gaseous fuel inlet manifold assembly 14. The fuel-laden combustion air flow, downstream of the gaseous fuel inlet manifold assembly 14, subsequently flows through the counter-swirl vane assembly 16, where a first portion of the fuel-laden air flows through the plurality of inner vanes 120 and a second portion of the fuel-laden air flows through the plurality of outer vanes 122. By passing through the plurality of inner vanes 120, the first portion of fuel-laden air may be imparted a swirl motion in a first orientation, for example clockwise. By passing through the plurality of outer vanes 122, the second portion of fuel-laden air may be imparted a swirl motion in a second orientation, for example, counter-clockwise, which is opposite to the first swirl orientation imparted by the plurality of inner vanes 120. The simultaneous opposite swirling motions imparted by the plurality of inner vanes 120 and the plurality of outer vanes 122 results in enhanced mixing of the gaseous fuel and the combustion air to form a fuel-air mixture in the burner assembly 10.

Referring now to FIGS. 2 and 3, once the fuel-air mixture exits the counter-swirl vane assembly 16, it enters the cylindrical housing section 71 which may be attached to the counter-swirl vane assembly 16 by bolting, for example, the first housing flange 72 of the cylindrical housing section 71 to the flange 128 of the counter-swirl vane assembly 16. After allowing the enhanced fuel-air mixing to develop in cylindrical housing section 71, the air-fuel flow may be accelerated in the frusto-conical housing section 75 of the burner assembly 10. Frusto-conical housing section 75 may be attached to the cylindrical housing section 71 of the burner assembly 10 by fastening with bolts, for example, the upstream flange 76 of the frusto-conical housing section 75 to the second housing flange 73 of the cylindrical housing section 71.

A first portion of the accelerated air-fuel mixture in frusto-conical housing section 75 may enter the nozzle assembly 18 and may flow into the first cylindrical shell 201, the second cylindrical shell 202 and the converging nozzle cone 203. A second portion of the air-fuel mixture in frusto-conical housing section 75 may flow around converging nozzle cone 203 through the annular volume formed between the converging nozzle cone 203 and the frusto-conical housing section 75. Converging nozzle cone 203 aids in directing the first portion of flow toward the annular volume formed between the cooling air tube 305 and the first cylindrical shell 201. Converging nozzle 203 also aids in directing said first portion of flow through the annular volume formed between the first cylindrical shell 201 and the second cylindrical shell 202.

The fuel-air mixture exiting the nozzle assembly 18 may be ignited to form a flame which may be anchored to the nozzle assembly 18 by the first bluff body surface 211 of cylindrical shell 201, the second bluff body surface 212 of second cylindrical shell 202, and the third bluff body surface 213 of cooling air tube 305. Furthermore, acceleration of the air-fuel mixture by the frusto-conical housing section 75 and the converging nozzle cone 203 may assist in preventing flashback of the flame into the burner assembly 10. The flame formed at the front of the nozzle assembly 18 is allowed to develop with the aid of the diverging cone 145, which may assist in anchoring and stabilizing said flame by, for example, inhibiting entrainment and blowoff. A fraction of the combustion air that entered cooling air tube 305 through cooling air tube inlet 307 flows the length of cooling air tube 305 and may assist in cooling the nozzle assembly 18 when the burner assembly 10 is in operation. Furthermore, as shown in FIG. 8, nozzle assembly 18 optionally includes a plurality of spin vanes 225 located proximate the inlet portion of nozzle 18, for stabilizing the burner flame.

The combustion air fan 80 may be controlled, for example, by a variable frequency drive (VFD), a damper mechanism or some other suitable mechanism which a person familiar with this technology would know how to select. The combustion air fan 80 may provide a flow of combustion air in excess of the stoichiometric amount required to burn the gaseous fuel supplied through the gaseous fuel inlet manifold assembly 14. Precise control of the resulting air-to-fuel ratio (A/F) of the fuel-air mixture and the enhanced gaseous fuel mixing achieved with counter-swirl vane assembly 16 may help minimize peak flame temperatures produced by burner assembly 10. Reduced peak flame temperatures result in lower emissions of NOx. NOx emissions, for instance, of burner 10 may be reduced to levels below 20 ppm at 3 percent $O_2$. Further, the premixing in burner 10 produces reduced levels of CO, VOCs, and the like. The burner preferably operates at 40 percent excess air, more preferably at approximately 50 percent excess air, which provides an adiabatic flame temperate of a maximum of 2800 degrees F., which is generally considered a threshold for thermal NOx formation.

The present invention is not limited to the particular structures disclosed herein, but rather encompasses variants as will be clear to persons familiar with burner technology and encompasses all structures recited and following from the language of the claims. For example, the present invention is not limited to a burner having, nor limited to the particular structure recited for, the counter-swirl vane assembly, fuel manifold, converging nozzle cone, and like components, unless the structure is stated in the claim. The embodiments described are illustrative, and the present invention is not limited to said embodiments.

What is claimed:

1. A burner assembly for low NOx combustion, comprising:

a combustion air inlet;

a gaseous fuel inlet;

a housing that defines a mixing zone downstream of the combustion air inlet and downstream of the gaseous fuel inlet for enabling mixing of fuel and combustion air to form a lean fuel-air mixture;

a nozzle assembly including:

at least one converging cone, spaced radially apart from the housing, for directing the fuel-air mixture; and at least one flame anchor formed by a bluff surface located proximate a front of the nozzle assembly for anchoring the flame.

2. The burner assembly according to claim 1 further comprising a swirl vane assembly for mixing the combustion air with the gaseous fuel upstream of the nozzle assembly.

3. The burner assembly according to claim 2 further comprising a plurality of inner vanes that impart a swirling motion in a first orientation and a plurality of outer vanes that impart a swirling motion in a second orientation wherein said first orientation may be the same as said second orientation.

4. The burner assembly according to claim 3 wherein the swirling motion imparted by the plurality of inner vanes is opposite in orientation to the swirling motion imparted by the plurality of outer vanes.

5. The burner assembly according to claim 1, wherein the bluff surface is formed proximate a front of the burner assembly and said downstream end is vaneless.

6. A burner assembly for lean, low NOx combustion, comprising:

a combustion air inlet;

a gaseous fuel inlet manifold located downstream from the combustion air inlet, the manifold having multiple ports for introducing gaseous fuel;

counter-swirl vanes located proximate the fuel inlet manifold, the counter-swirl vanes including inner vanes oriented to impart, to a first portion of flow, a swirl in a first orientation and outer vanes oriented to impart, to a second portion of flow, a swirl in a second orientation that is opposite to that of the first orientation, whereby mixing between the fuel and the combustion air is enhanced and whereby mixing between the first portion and second portion of flow is promoted; and a nozzle assembly that is located downstream from and spaced apart from the counter-swirl vanes and that is located downstream from and spaced apart from the gaseous fuel inlet manifold, thereby forming a mixing zone between the vanes and the nozzle assembly, the nozzle assembly including at least one flame anchor formed by a bluff surface located proximate a front of the nozzle assembly for anchoring the flame.

7. The burner assembly according to claim 6 further comprising a fan coupled to the combustion air inlet, the fan being adapted for providing combustion air through the combustion air inlet to the nozzle assembly in excess of the stoichiometric amount such that the fuel-air mixture is fuel-lean.

8. The burner assembly according to claim 7 further comprising a variable-speed drive coupled to the fan for controlling the flow of the combustion air through the burner.

9. The burner assembly according to claim 8 wherein the drive includes a variable frequency drive.

10. The burner assembly according to claim 6 wherein at least a portion of the ports of the manifold are distributed in a plane that generally is perpendicular to a longitudinal axis of the burner assembly.

11. The burner assembly according to claim 6 further comprising a converging housing cone generally located between the vanes and the front of the nozzle assembly.

12. The burner assembly according to claim 11, wherein the nozzle assembly includes at least one converging nozzle cone that cooperates with the converging housing cone to direct flow of the fuel-air mixture, the bluff surface being formed proximate the converging nozzle cone.

13. The burner assembly according to claim 6, wherein the nozzle assembly includes at least one converging nozzle cone to direct flow of the fuel-air mixture.

14. The burner assembly according to claim 6 further comprising a diverging cone extending forward from the nozzle assembly, whereby the diverging cone inhibits entrainment toward the front of the nozzle.

15. The burner assembly according to claim 6 further comprising a cooling air tube extending from the combustion air inlet, through the gaseous fuel manifold, and into a burner housing.

16. The burner assembly according to claim 15 wherein the nozzle assembly includes an oil nozzle, the burner assembly further comprises an oil supply tube capable of providing oil to the oil nozzle.

17. The burner assembly according to claim 16 further comprising an atomizing air tube capable of providing atomizing air to the oil nozzle.

18. A method for generating low NOx, premixed combustion, comprising:

supplying and controlling flow of excess combustion air at a burner inlet;

introducing gaseous fuel to the burner through a multi-port manifold located downstream the burner inlet;

mixing the excess combustion air with the gaseous fuel by means of counter-swirl vanes located proximate the multi-port manifold;

directing the air-fuel mixture flow through a nozzle assembly located generally within a converging housing cone; and providing a flame anchor formed by a bluff surface located proximate a front of the nozzle assembly for anchoring the flame.

19. The method according to claim 18 wherein the combustion air is supplied by a fan that is coupled to the burner inlet.

20. The method according to claim 19 wherein the fan is controlled by a variable-speed drive coupled to the fan.

21. The method according to claim 18 wherein the fuel-air mixture is directed through a converging housing cone generally located between the vanes and the front of the nozzle assembly.

22. The method according to claim 21 wherein the nozzle assembly includes at least one converging nozzle cone that cooperates with the converging housing cone to direct flow of the fuel-air mixture, the bluff surface being formed proximate the converging nozzle cone.

23. The method according to claim 18 wherein the burner assembly further comprises a cooling air tube extending from the combustion air inlet, through the gaseous fuel manifold, and into the burner housing for providing cooling air to the nozzle assembly.

24. The method according to claim 23 wherein the nozzle assembly includes an oil nozzle, the burner assembly further comprises an oil supply tube for providing oil to the oil nozzle, and an atomizing air tube for providing atomizing air to the oil nozzle.

25. The method according to claim 18 wherein combustion from the burner assembly achieves NOx emissions levels below 20 ppm at 3 percent $O_2$.

26. The method according to claim 22 wherein the nozzle cone is spaced radially apart from the housing cone.

27. The burner assembly according to claim 1 further comprising an oil nozzle located concentric with the converging cone; an oil supply tube for providing oil to the oil nozzle; and an air tube extending from the combustion air inlet capable of providing cooling air to the oil nozzle during operation of the burner assembly on oil and providing cooling air to the oil nozzle during operation of the burner assembly only on gaseous fuel.

* * * * *